US008464989B2

(12) United States Patent
Busch

(10) Patent No.: US 8,464,989 B2
(45) Date of Patent: Jun. 18, 2013

(54) BACKER STRIP LOAD DISTRIBUTION DEVICE FOR A SUPPORT STRUCTURE

(76) Inventor: Charles D. Busch, Joliet, IL (US)

( * ) Notice: Subject to any disclaimer, the term of this patent is extended or adjusted under 35 U.S.C. 154(b) by 569 days.

(21) Appl. No.: 12/459,526

(22) Filed: Jul. 2, 2009

(65) Prior Publication Data

US 2011/0001023 A1 Jan. 6, 2011

(51) Int. Cl.
*A47B 96/06* (2006.01)

(52) U.S. Cl.
USPC ..... 248/205.1; 248/345.1; 293/128

(58) Field of Classification Search
USPC ..... 248/205.1, 200.1, 345.1; 293/128
See application file for complete search history.

(56) References Cited

U.S. PATENT DOCUMENTS 2,291,966 A * 8/1942 Joseph ..... 248/215
3,214,122 A * 10/1965 Frederickson ..... 248/220.22
3,606,431 A * 9/1971 Kunevicius ..... 293/128
3,606,432 A * 9/1971 Honatzis ..... 293/128
3,856,194 A * 12/1974 Helm ..... 224/326
3,861,110 A * 1/1975 Bartlett ..... 52/718.05
4,265,383 A * 5/1981 Ferguson ..... 224/326
4,311,295 A * 1/1982 Jamar, Jr. ..... 248/222.11
4,403,761 A * 9/1983 Jamar ..... 248/447.1
5,058,843 A * 10/1991 Koster ..... 248/223.41
5,259,175 A * 11/1993 Schmidt ..... 56/17.2
5,536,540 A * 7/1996 Borys et al. ..... 428/31
6,302,362 B1 * 10/2001 Moore ..... 248/73

* cited by examiner

*Primary Examiner* — Anita M King
(74) *Attorney, Agent, or Firm* — Cherskov Flaynik & Gurda, LLC

(57) ABSTRACT

A backer strip load distribution device 10 includes a load distribution member 12 for disbursing a load imparted upon the device 10 over an area of the wall portion 6 engaged by a back wall 14 of the distribution member 12. The device 10 also includes an alignment member 16 for disposing a support structure 4 (prior art) upon a preselected portion of the load distribution member 12.

8 Claims, 14 Drawing Sheets

BACKER STRIP LOAD DISTRIBUTION DEVICE FOR A SUPPORT STRUCTURE

BACKGROUND OF THE INVENTION

1. Field of the Invention

The present invention relates generally to load distribution devices and, more particularly, to a load distribution strip removably secured to a wall engagement side of a support structure that is fastened to a wall portion, the support structure ultimately receiving the weight imparted from objects secured thereto.

2. Background of the Prior Art

Slotted support rails or similar structures are vertically fastened to walls to provide support structures for brackets that are removably secured to the support structure via slots longitudinally centered along the support structure. The brackets that are inserted into the slots are designed to receive shelving resulting in a book case configuration mounted to a wall. The items supported by the shelving can be relatively heavy causing a large force to be imparted upon the shelving and correspondingly upon the brackets and support structures.

The problem with the prior art is that the large force imparted upon the support structures results in indentations or similar damage to wall portions engaged by the support structures.

A need exists for a device that prevents the support structure from damaging the wall portions engaged by the support structure. Further, a need exists for the device and the support structure to be secured together to promote a quick and relatively easy installation of the assembled device and support structure upon a wall by only one person.

SUMMARY OF THE INVENTION

It is a principle object of the present invention to provide a backer strip load distribution device for a support structure that is secured to a wall portion, the support structure receiving a force imparted from objects ultimately secured to the support structure. A feature of the device is a load distribution member. An advantage of the device is that the support structure is prevented from indenting or otherwise damaging the wall portion to which the support structure is fastened.

Another object of the present invention is to provide a device that is removably joined to the support structure to allow a user of the device to hold only the support structure while the device retains a predetermined position relative to the support structure irrespective of the orientation of the support structure. A feature of the device is an alignment member integrally or independently joined to the load distribution member. An advantage of the device is that the alignment member ultimately disposes the support structure upon the load distribution member at a predetermined position. Another advantage of the device is that the alignment member removably secures the support structure to the device.

Yet another object of the present invention is to provide a device with increased holding force upon the support structure. A feature of the device is an alignment member having angled side walls that grasp lower portions of cooperatively angled inner side walls of the support structure. An advantage of the device is that the alignment member has an increased holding force upon the support device without increasing the size or cost of the alignment member.

Still another object of the present invention is to provide a device with even more holding force upon the support structure. A feature of the device is an alignment member with rail members with relative long angled side walls that grasp portions of cooperatively angled inner side walls of the support structure. Another feature of the device is that the rail members are manually deformable to displace the rail members to allow the support structure to engage the load distribution member without obstruction from the rail members, whereupon, the rail members are released allowing the angled side walls of the rail members to engage and grasp the inner angular side walls of the support structure. An advantage of the device is that the increased grasp of the device upon the support structure allows a relatively heavy support structure to be removably secured to the device without premature separation as the support structure is vertically fastened to a wall portion with the device therebetween.

Another object of the present invention is to provide a device that is removably secured to a support structure via means external to the support structure. A feature of the device is opposite deformable securing arms integrally joined to side walls of the load distribution member. An advantage of the device is that the securing arms can be manually separated a distance that allows the support structure to engage the load distribution member, whereupon, the securing arms are manually released to "spring" back to engage outer side walls of the support structure, thereby saving manual assembly time for joining together the support structure and the device.

Another object of the present invention is to provide a device that has increased load distribution capabilities. A feature of the device is an alignment member that engages an inner top wall of the support structure. An advantage of the device is that more surface area of engagement is provided between the support structure and the device, thereby better distributing a force across a wall portion surface area to prevent indenting or damage to the wall portion.

Other objects of the present invention are to provide a device that is easy to install, easy to assembly with a support structure, easy to cut, symmetrically disposed the support structure upon a load distribution member, adapts to wall surface non-planar irregularities, prevents debris build-up, increases a load distribution area, permits unobstructed slotting of brackets upon the support structure, and that has low manufacturing costs.

Briefly, the invention provides a backer strip load distribution device for a support structure secured to a wall portion comprising a load distribution member disposed between a support structure and a wall portion; an alignment member for disposing the support structure upon a predetermined portion of said load distribution member; means for securing said load distribution member to the support structure; and means for securing the support structure to the wall portion while said load distribution member is secured to the support structure without said load distribution member obstructing the securing of the support structure to the wall portion, whereby, a backer strip load distribution device is provided that secures to the support structure such that said backer strip load distribution device is disposed between the support structure and the wall portion, thereby preventing engagement of the support structure upon the wall portion and resulting in a distribution of a load from the support structure upon said backer strip load distribution device such that the wall portion is not damaged.

The invention further provides a support structure load distribution device comprising a substrate member secured to a support structure that is ultimately secured to a wall portion; an alignment member for disposing the support structure upon a predetermined portion of said substrate member; a securing member for securing the support structure to said substrate member; and means for preventing said substrate member from obstructing the securing of the support structure to the wall portion, whereby, said substrate member is ultimately secured between the support structure and the wall portion thereby preventing the support structure from damaging the wall portion due load bearing objects ultimately secured to the support structure.

The invention also provides a device for preventing a support structure from damaging a wall portion comprising a load distribution member for disbursing a load imparted upon the support structure; an alignment member for disposing the support structure upon a preselected portion of said load distribution member; and a securing member for removably joining the support structure to said load distribution member such that the support structure is allowed to be secured to a wall portion, whereby, said load distribution member is disposed between the support structure and the wall portion, thereby preventing the wall portion from being indented.

BRIEF DESCRIPTION OF THE DRAWINGS

These and other objects, advantages and novel features of the present invention, as well as details of an illustrative embodiment thereof, will be more fully understood from the following detailed description and attached drawings, wherein.

DESCRIPTION OF THE PREFERRED EMBODIMENT

Figure 1A:
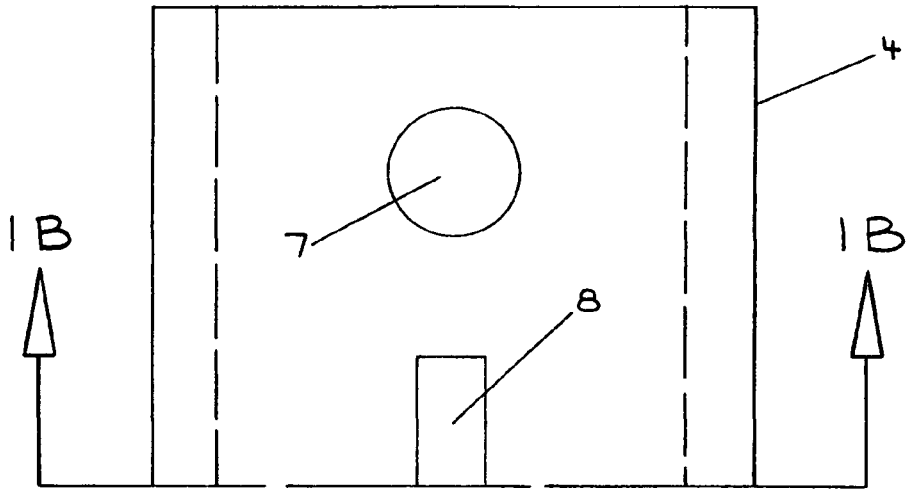
FIG. 1A PRIOR ART
FIG. 1A is a top elevation view of a portion of a prior art support structure that attaches to a wall portion.
Figure 1B:
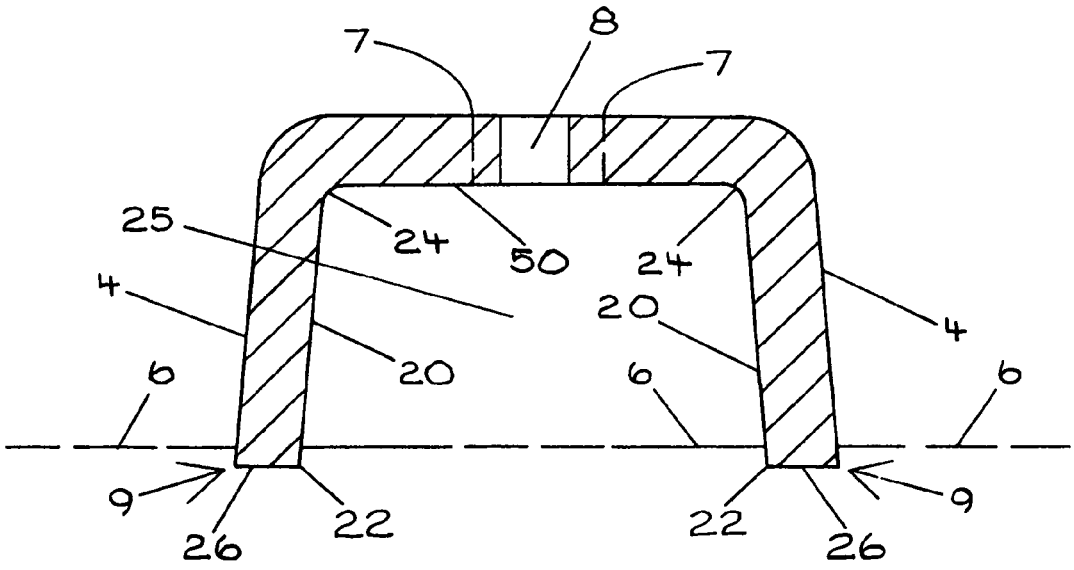
FIG. 1B PRIOR ART
FIG. 1B is a sectional view of FIG. 1A taken along line 1B-1B.

Referring now to the drawings, an in particular to FIGS. 1A and 1B (prior art), a typical support structure 4 is secured to a wall portion 6. The support structure 4 includes fastener receiving apertures 7 to promote the securing of the support structure 4 to the wall portion 6, and bracket slots 8 for removably receiving brackets (not depicted) that support shelving and other objects (not depicted) that impart a force or load upon the support structure 4. The force imparted upon the support structure 4 urges the support structure 4 into the wall portion 6, resulting in indented sections 9 of the wall portion 6 engaged by the support structure 4.

Figure 2A:
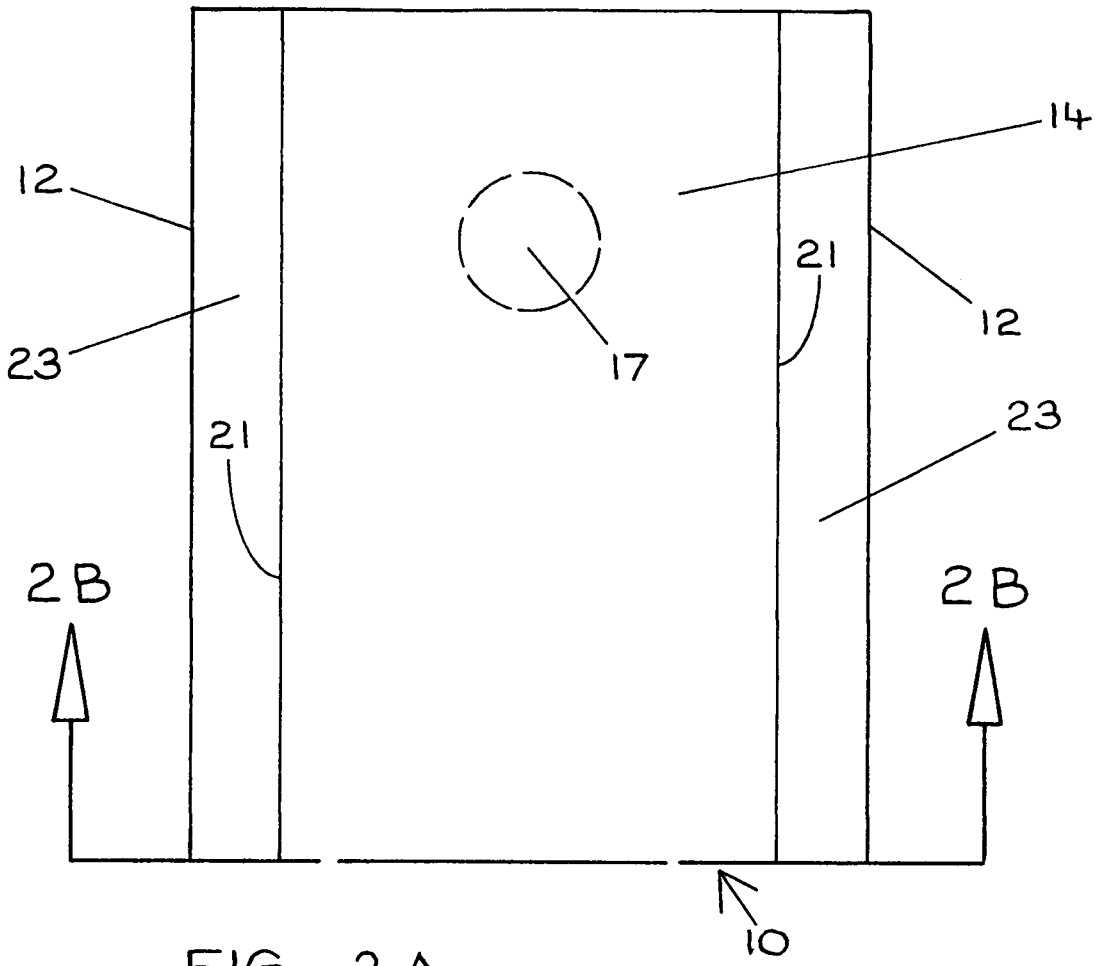
FIG. 2A is a top elevation view of a portion of a backer strip load distribution device for a support structure in accordance with the present invention.
Figure 2B:
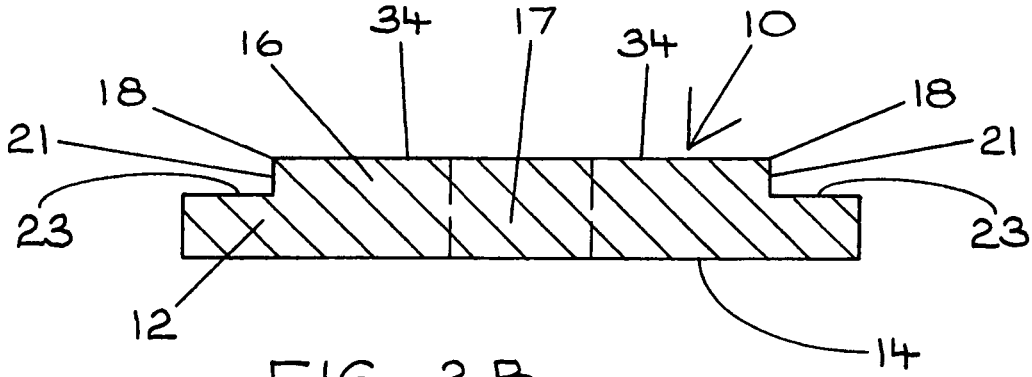
FIG. 2B is a sectional view of the device of FIG. 2A taken along line 2B-2B.
Figure 3:
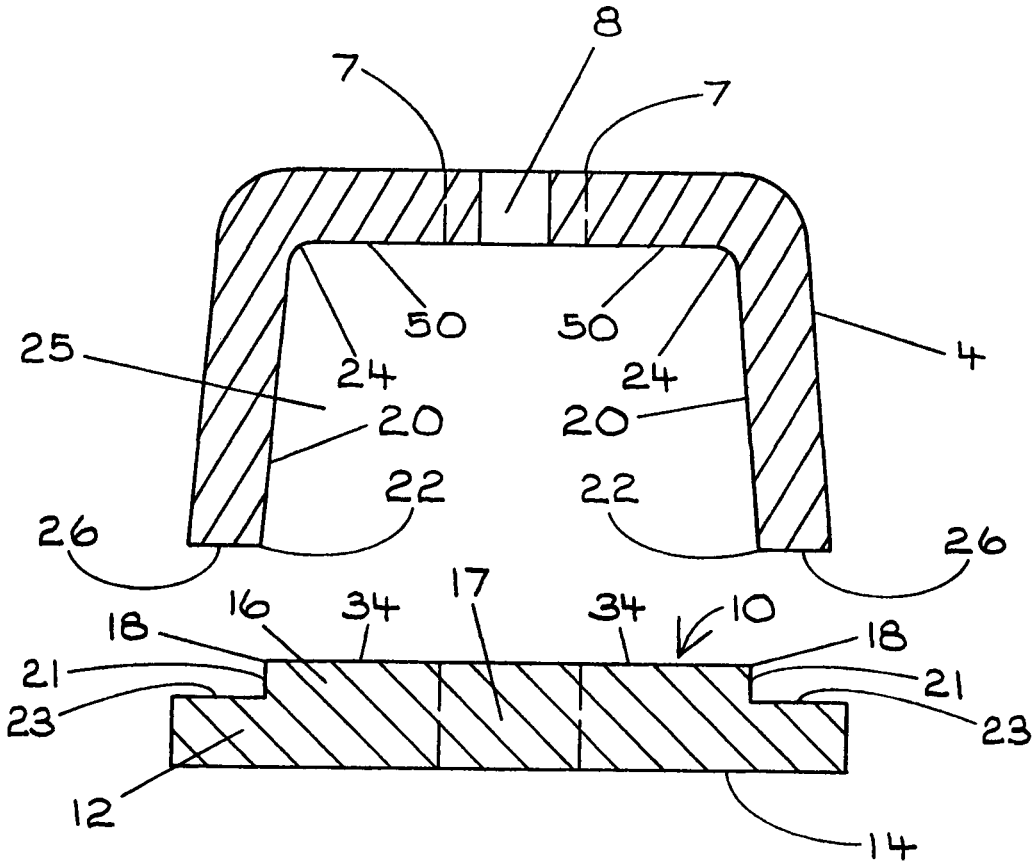
FIG. 3 is a sectional view of the support structure of FIG. 1B disposed above the sectional view of the device of FIG. 2B.

Referring now to FIGS. 2A, 2B and 3, a backer strip load distribution device for a support structure 4 ultimately secured to a wall portion 6 in accordance with the present invention is denoted as numeral 10. The device 10 includes a load distribution member 12 or substrate portion for disbursing a load imparted upon the device 10 over an area of the wall portion 6 engaged by a back wall 14 of the distribution member 12. The device 10 further includes an alignment member 16 for disposing the support structure 4 upon a preselected portion of the load distribution member 12. Apertures 17 that extend through the joined load distribution and alignment member 12 and 16, are congruently and axially aligned with cooperating apertures 7 in the support structure 4 to allow a fastener (not depicted) to insert through the support structure 4, alignment member 16, load distribution member 12, and into framing wood in the wall portion 6, thereby securing the device 10 between the support structure 4 and the wall portion 6 to prevent indentations 9 in the wall portion 6.

The load distribution member 12 may be fabricated from a myriad of deformable materials, including but not limited to rubber, plastic, styrene and cork. The deformable material directly engaged by the support structure 4 "absorbs" some of the force from the support structure 4 as the engaged material is compressed. The remaining force imparted by the support structure 4 upon the distribution member 12 is distributed across the deformable material of the distribution member 12 not directly engaged by the support structure 4. The rigidity and quantity of the deformable material of the distribution member 12 between the support structure 4 and the wall portion 6 is selected based upon the force ultimately imparted upon the distribution member 12 by the support structure 4.

The rigidity of the deformable material selected for the distribution member prevents the support structure 4 from indenting or otherwise damaging the wall portion 6. If the magnitude of the force imparted from the support structure 4 to the distribution member 12 is greater than the deformable material can distribute without damaging the wall portion 6, then the distribution member 12 must be fabricated from a non-deformable material such as hard plastic, wood or metal. However, a distribution member 12 fabricated from a non-deformable material may indent the wall portion 6 when a magnitude of force imparted upon the support structure 4 is greater than the surface area of the back wall 14 of the distribution member 12 is capable of disbursing without damage to the wall portion 6. Thus, the device 10 is color coded to indicate the maximum force that may be imparted upon a respective distribution member 12 without damaging the wall portion 6.

The alignment member 16 may be integrally or independently joined to the distribution member 12. The alignment member 16 may be fabricated from the same deformable and non-deformable materials as the distribution member 12. Further, the alignment member 16 may be fabricated from of material dissimilar to the material of fabrication for the distribution member 12, including a material of fabrication being non-deformable material for the alignment member 16, while the distribution member 12 is fabricated from a deformable material; or a deformable material for the alignment member 16 and a non-deformable material for the distribution member 12. The alignment member 16 guides the support structure 4 upon the distribution member 12 such that the support structure 4 is symmetrically disposed upon the distribution member 12, thereby distributing the load imparted upon the distribution member 12 from the support structure 4 such that damage to the wall portion 6 is prevented.

The alignment member 16 also secures the support structure 4 to the distribution member 12 via relatively small cooperating edge portions 18 engaging inner angular walls 20 of the support structure 4, without opposite side walls 21 of the alignment member 16 engaging the inner angular walls 20. The side walls 21 of the alignment member 16 are perpendicular to corresponding top walls 23 of the distribution member 12, the top walls 23 ultimately receiving bottom walls 26 of the support structure 4 thereupon. The inner angular walls 20 are separated a distance slightly greater at inner opposite edges 22 than the distance separating inner opposite arcuate portions 24, thereby forming a trapezoidal recess 25 that allows the opposite edges 22 of the support structure 4 to avoid the edge portions 18 of the alignment member 16 as the support structure 4 is manually urged toward the distribution member 12. As the support structure 4 is urged closer to the alignment member 16, the edge portions 18 forcibly engage the inner angular walls 20 until the edge portions 18 are sufficiently "compressed" to provide a relatively small "retaining" force that ultimately maintains the support structure 4 upon the top walls 23 of the distribution member 12, irrespective of the now assembled support structure 4 and device 10 being vertically orientated while a user grasps only the support structure 4 or only the distribution member 12.

Referring now to FIGS. 4A, 4B and 5A-5C, the device 10 is depicted with the alignment member 16 having angled side walls 28 that cooperate with the inner angular walls 20 of the support structure 4 to ultimately increase the retaining force maintaining the support structure 4 upon the top walls 23 of the distribution member 12. The alignment member 16 includes a trapezoidal configuration with dimensions that cooperate with the recess 25 of the support structure 4 to allow the support structure 4 to be manually urged upon the alignment member 16 until lower portions of the inner angular walls 20 congruently and forcibly engage the side walls 28 of the alignment member. The lower portions of the inner angular walls forcibly and laterally compress the alignment member 16 to provide a retaining force that ultimately maintains the support structure 4 upon the top walls 23 of the distribution member 12. The retaining force generated by the compressed alignment member 16 is relatively larger than the retaining force generated by the device 10 of FIG. 2 due the greater area of engagement between the inner angular walls 20 of the support structure 4 and the side walls 28 of the alignment member 16.

Referring now to FIGS. 6A, 6B and 7A-7C, the device 10 is depicted with the alignment member 16 having angled side walls 30 that extend from the top walls 23 of the distribution member 12 at an angle slightly greater than ninety degrees and to a distance or lateral dimension relatively longer than the corresponding dimension of the angled side walls 28 of the device 10 of FIG. 3. The greater the lateral dimension of the angled side walls 30, the greater the holding force of the alignment member 16 upon the support structure 4, making the assembled device 10 and support structure easier to manually attach to the wall portion 6. However, the greater the lateral dimension of the angled side walls 30, the more difficult it is to manually urge the support structure 4 upon the distribution member 12 due to friction between the inner angular walls 20 of the support structure 4 and the angled side walls 30 of the alignment member 16. To overcome this problem, an arcuate recess 32 is included in a top wall 34 of the alignment member 16. The arcuate recess 32 cooperates with the angled side walls 30 to provide rail members 36 that can be manually "squeezed" together to allow a section of the support structure 4 to be disposed upon a cooperating section of the distribution member 12; whereupon, an adjacent section of the rail members 36 are manually squeezed together to allow a cooperating section of the support member 12 to be disposed upon a cooperating section of the support structure 4. The method is repeated longitudinal across the alignment member 16.

Referring now to FIGS. 8A, 8B and 9A-9C, the device 10 is depicted but with securing arms 40 added to the distribution member 12. The securing arms 40 increase the holding force of the device 10 upon the support structure 4. The securing arms 40 are arcuate extensions of side walls 42 (see FIG. 4B) of the distribution member 12. The securing arms 40 form a "half donut" configuration that includes an arc slightly greater than one-hundred and eighty degrees. The configuration of the securing arms 40 disposes end portions 44 to forcibly engage outer side walls 46 of the support structure 4, thereby adding another device 10 holding force that cooperates with the holding force of the angled side walls 28 upon the inner angular walls 20 of the support structure 4.

Figure 10A:
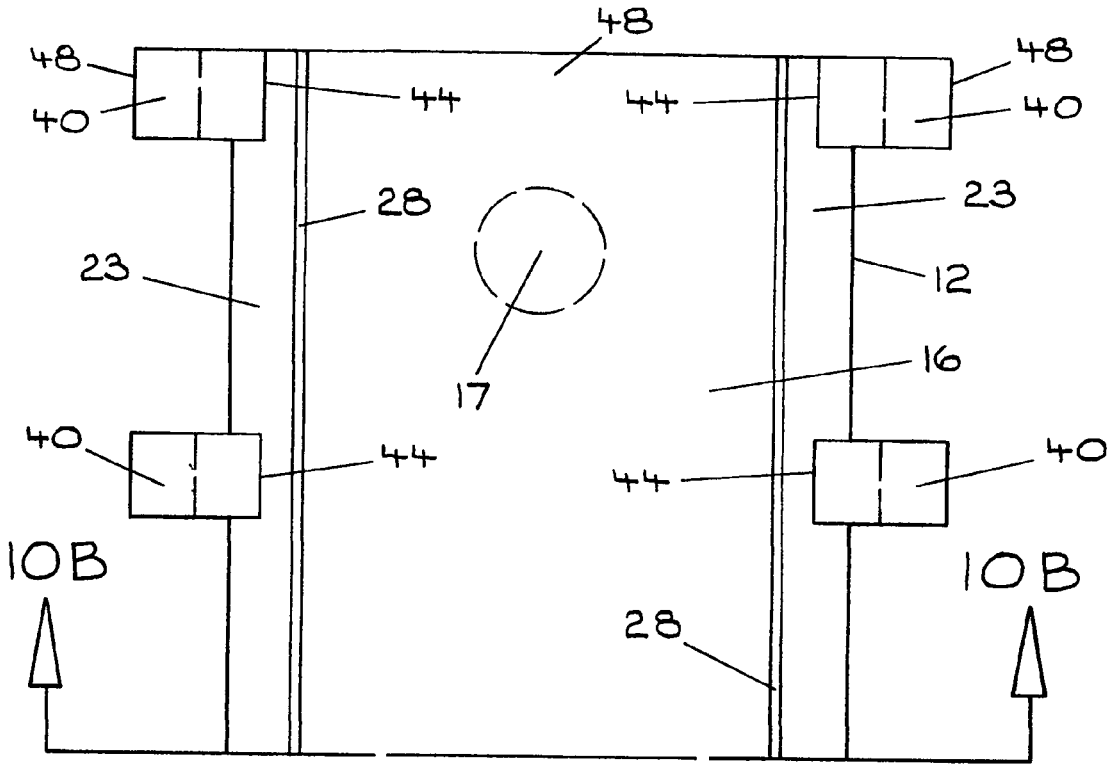
FIG. 10A is a top elevation view of the device of FIG. 8A, but with intermittently disposed securing arms.
Figure 10B:
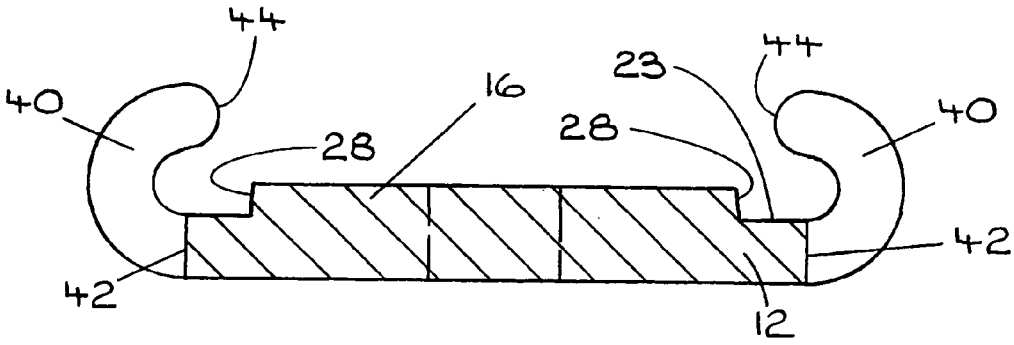
FIG. 10B is a sectional view of the device of FIG. 10A taken along line 10B-10B.
Figure 11A:
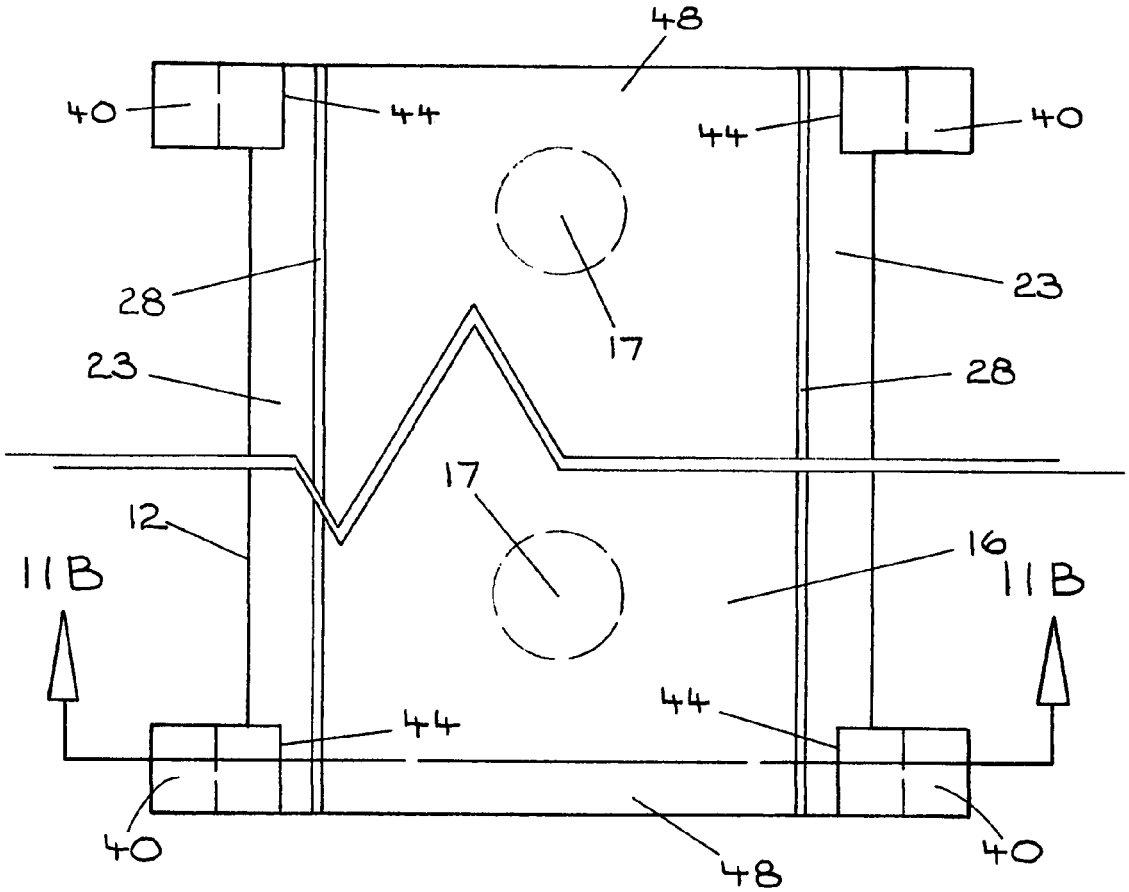
FIG. 11A is a top elevation view of the device of FIG. 10A, but with securing arms disposed at end portions of a load distribution member.
Figure 11B:
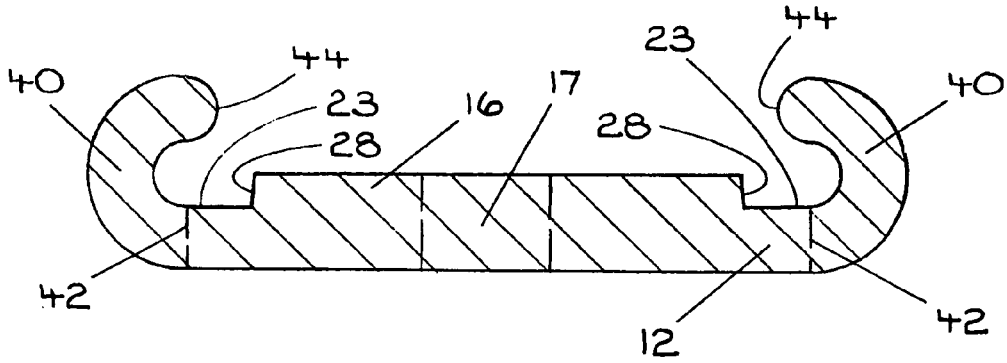
FIG. 11B is a sectional view of the device of FIG. 11A taken along line 11B-11B.

The increased holding force of the device 10 allows a relatively heavy support structure 4 to be secured to the device 10 to allow the device and support structure 4 to be vertically orientated without separating, thereby allowing the heavy support structure 4 to be quickly secured to a wall portion 6 with the device 10 therebetween to ultimately receive relatively heavy loads upon the support structure 4 without damaging the wall portion 6. The securing arms 40 may longitudinally and continuously extend across the distribution member 12 (see FIG. 8B), may be longitudinally and intermittently disposed across the distribution member 12 (see FIGS. 10A and 10B), or may be disposed at end portions 48 of the distribution member 12 (see FIGS. 11A and 11B). The securing arms 40 operate by manually forcing apart oppositely positioned securing arms 40 such that cooperating portions of the support structure 4 are disposed upon cooperating portions of the top walls 23 of the distribution member 12, whereupon, the securing arms 40 are released allowing the securing arms to "spring back" to forcibly engage the outer walls 46 of the support structure 4. The force exerted upon the outer walls 46 by the securing arms 40 prevents the position of the support structure 4 upon the distribution member 12 from being adjusted after manually releasing securing arms 40, thereby requiring respective ends of the support structure 4 and the distribution member 12 to be aligned before the securing arms 40 are manually released. Irrespective of the configuration of the device 10 depicted in the aforementioned figures, a gap 52 is maintained between the support structure 4 and the alignment member 16 of the device 10, thereby reducing the accumulation of foreign matter between the support structure 4 and the alignment member 16.

Figure 4A:
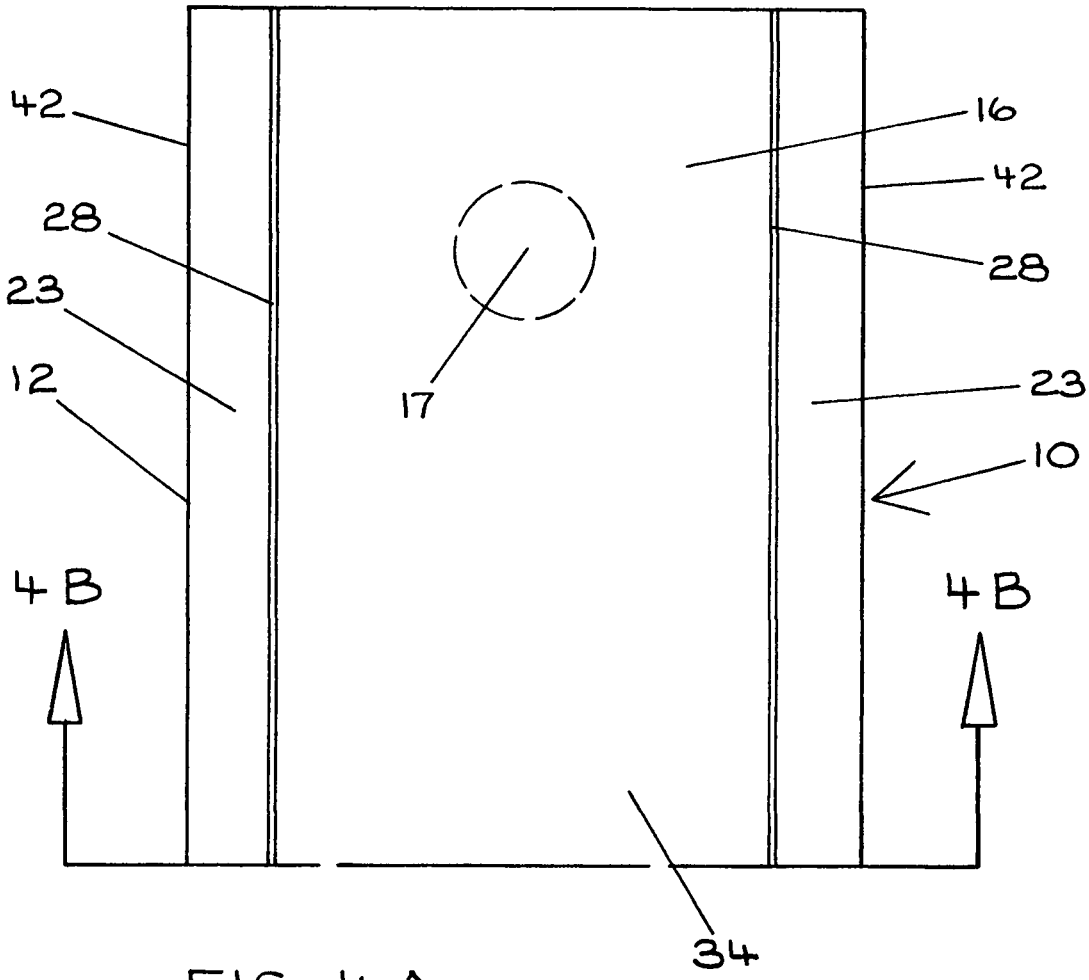
FIG. 4A is a top elevation view of the device of FIG. 2A, but with an alignment member having angled side walls 28 in accordance with the present invention.
Figure 4B:
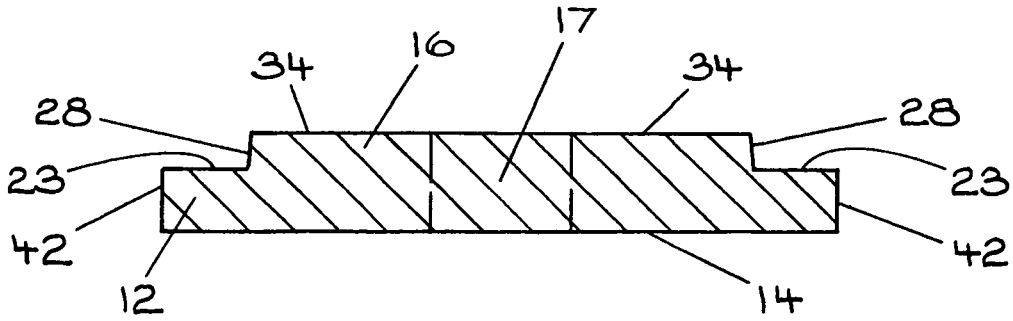
FIG. 4B is a sectional view of the device of FIG. 4A taken along line 4B-4B.
Figure 5A:
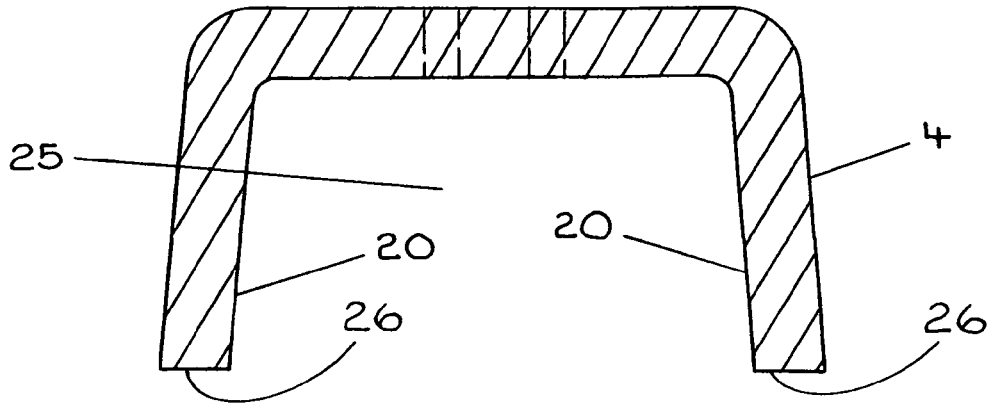
FIG. 5A PRIOR ART
FIG. 5A is the sectional view of the support structure of FIG. 1B.
Figure 5C:
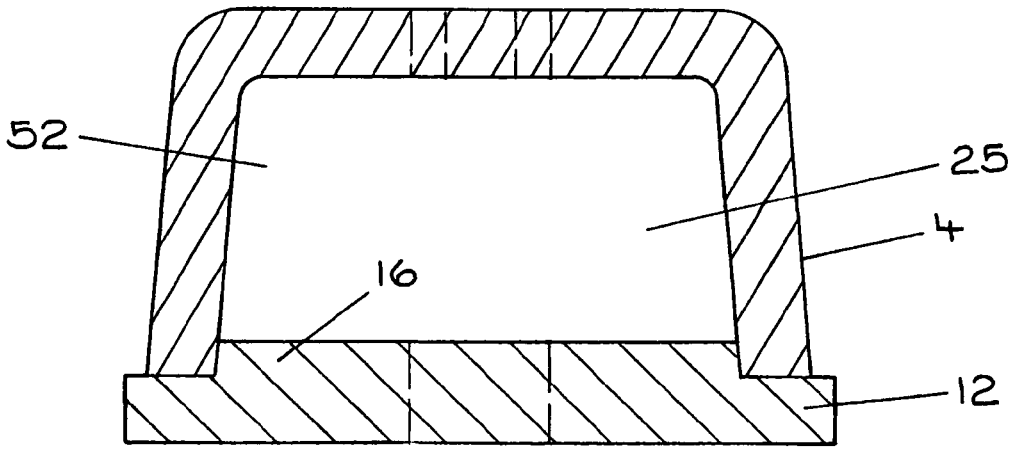
FIG. 5C is a sectional view of support structure of FIG. 5A disposed upon the device of FIG. 5B.
Figure 5B:
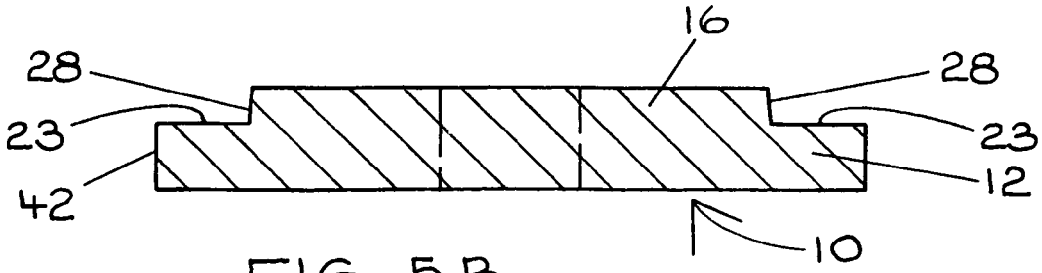
FIG. 5B is the sectional view of the device of FIG. 4B.
Figure 6A:
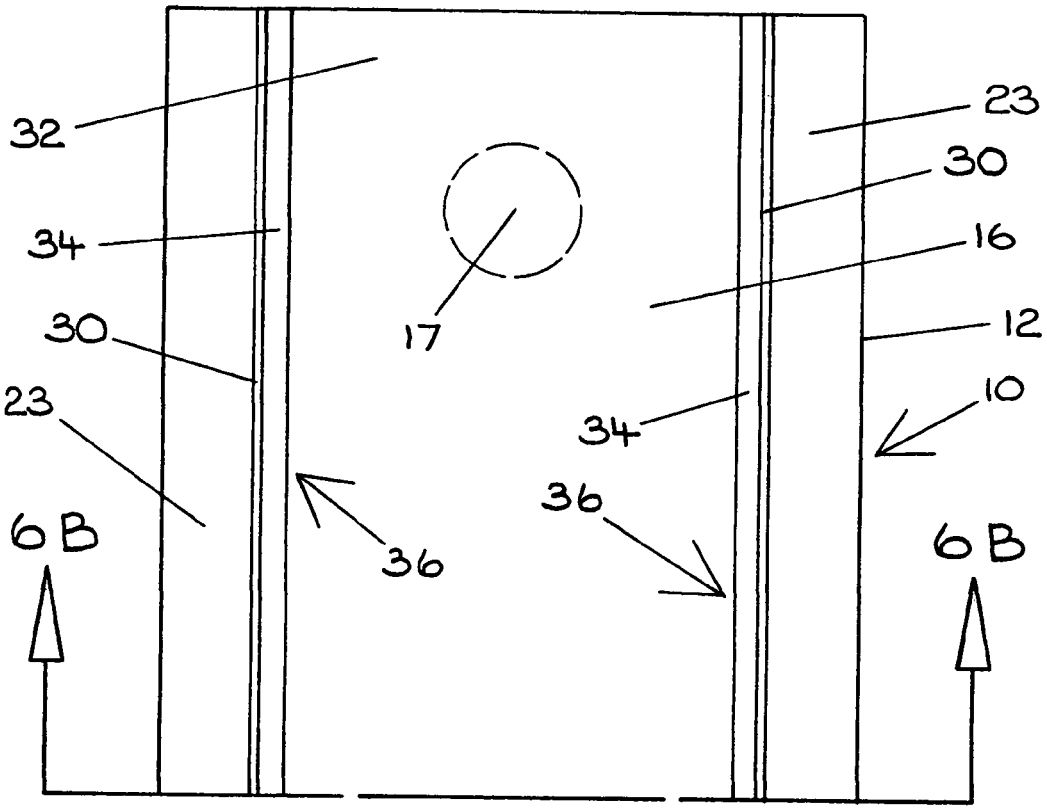
FIG. 6A is a top elevation view of the device of FIG. 2A, but with an alignment member having angled side walls 30 forming a recess 32 in accordance with the present invention.
Figure 6B:
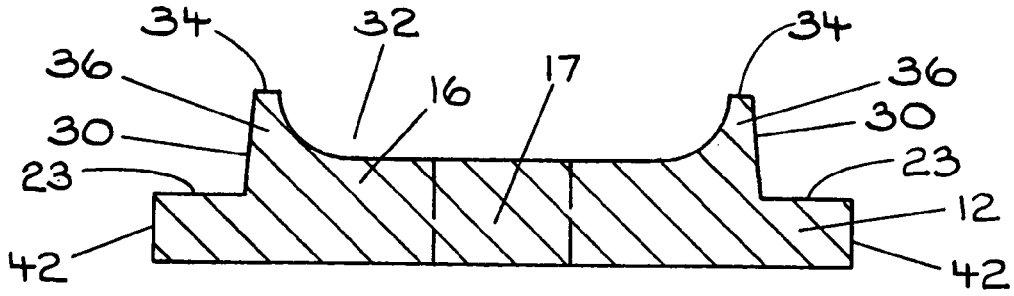
FIG. 6B is a sectional view of the device of FIG. 6A taken along line 6B-6B.
Figure 7A:
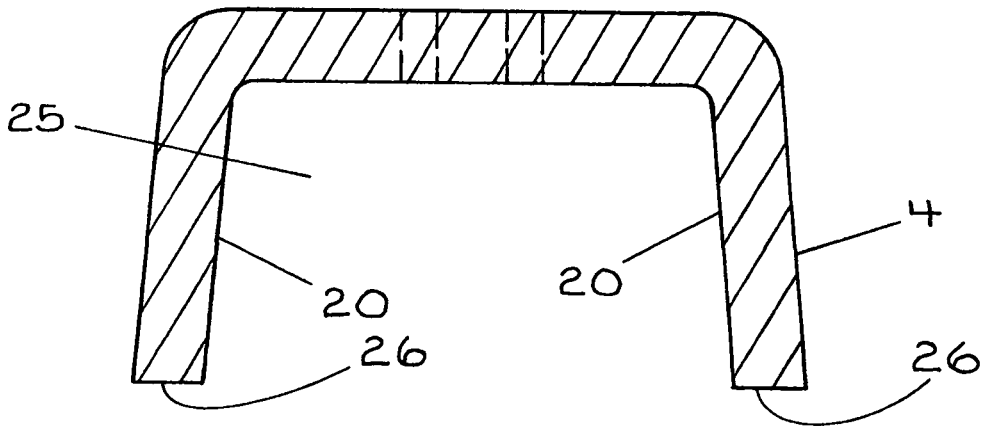
FIG. 7A is the sectional view of the support structure of FIG. 1B.
Figure 7C:
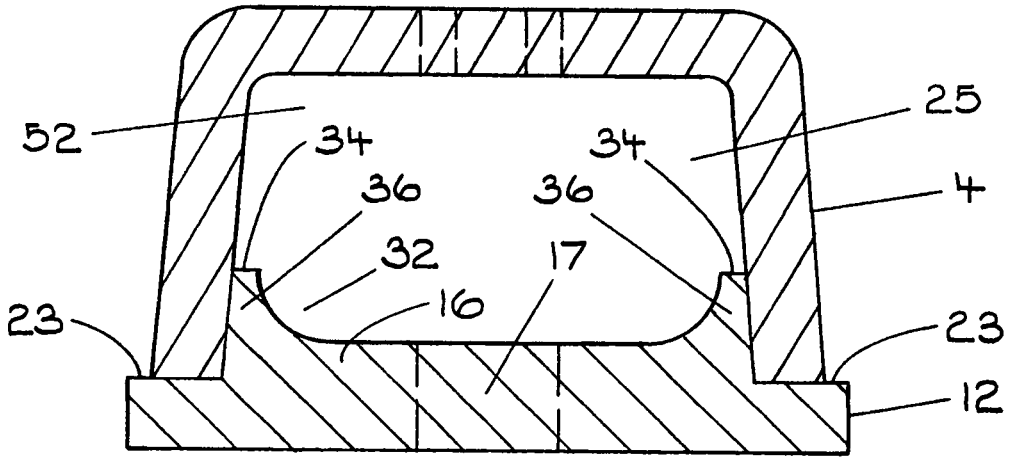
FIG. 7C is a sectional view of support structure of FIG. 7A disposed upon the device of FIG. 7B.
Figure 7B:
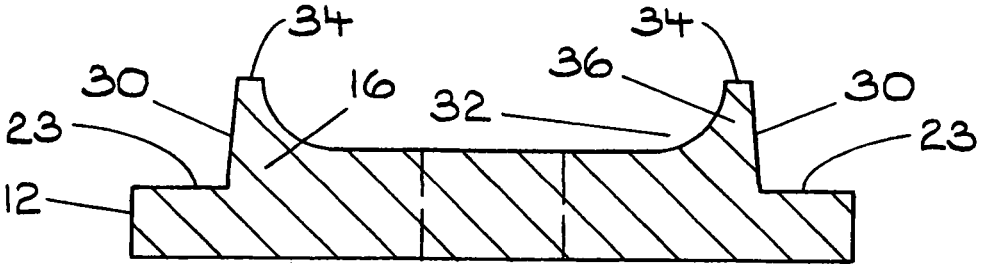
FIG. 7B is the sectional view of the device of FIG. 6B.
Figure 8A:
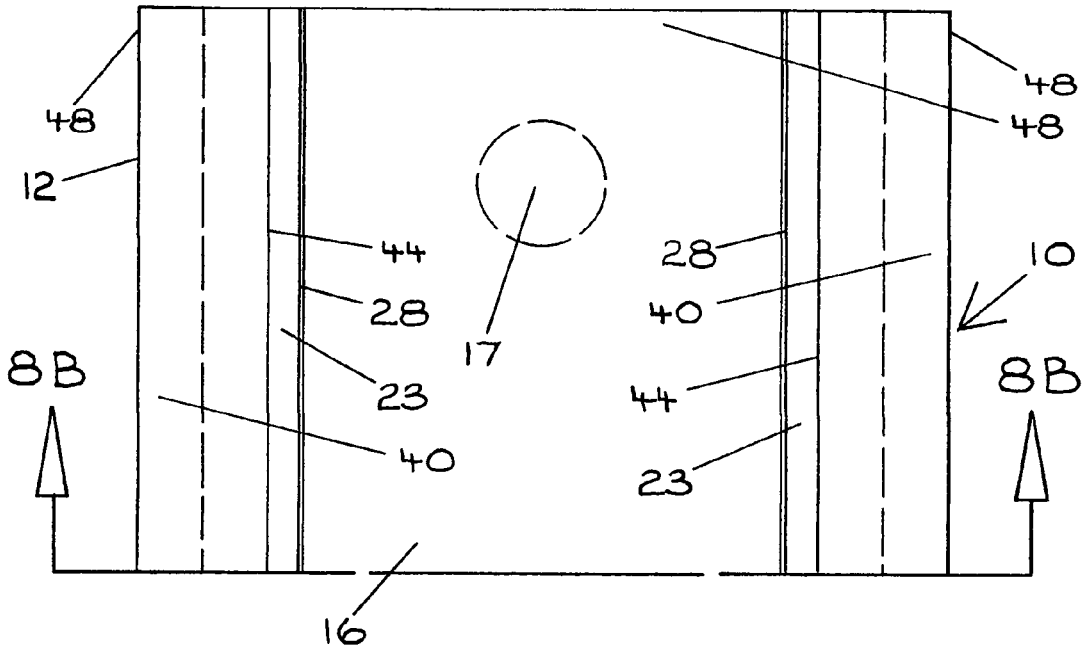
FIG. 8A is a top elevation view of the device of FIG. 4A, but with securing arms added to a load distribution member in accordance with the present invention.
Figure 8B:
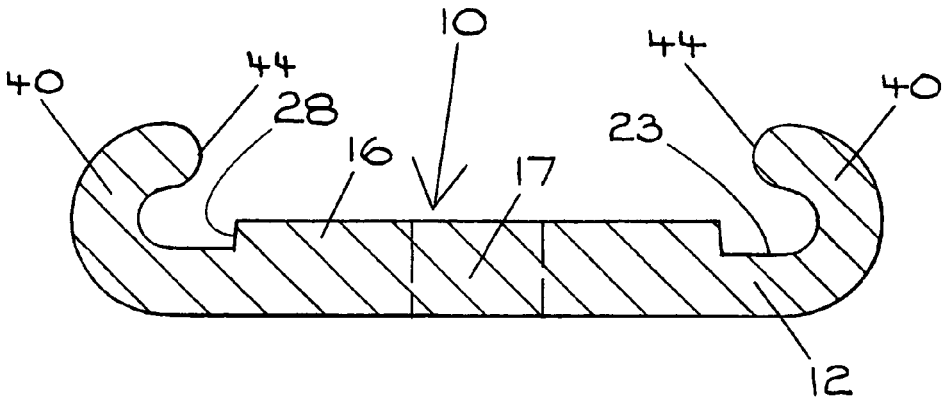
FIG. 8B is a sectional view of the device of FIG. 8A taken along line 8B-8B.
Figure 9A:
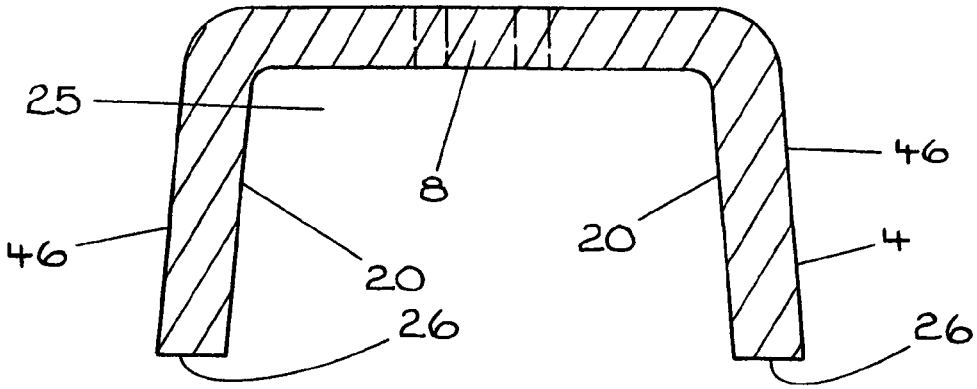
FIG. 9A is the sectional view of the support structure of FIG. 1B.
Figure 9C:
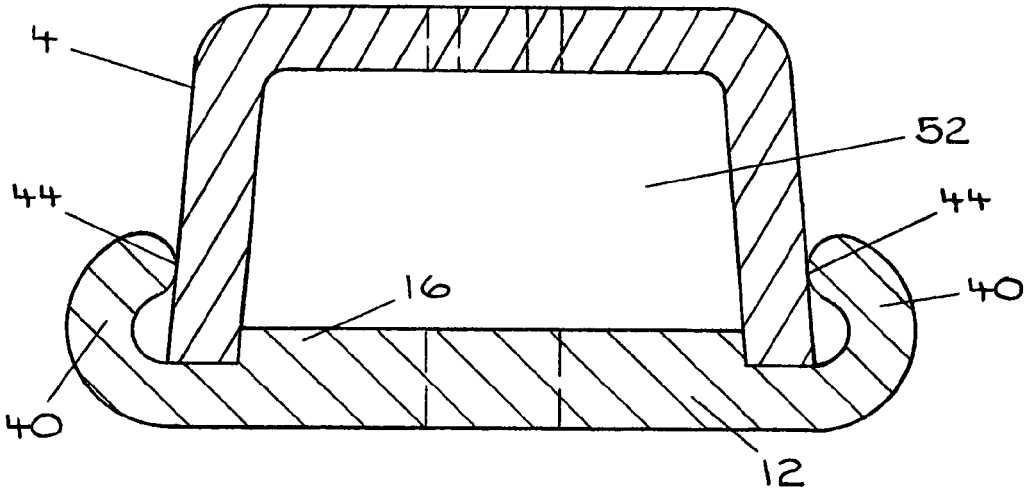
FIG. 9C is a sectional view of support structure of FIG. 9A disposed upon the device of FIG. 9B.
Figure 9B:
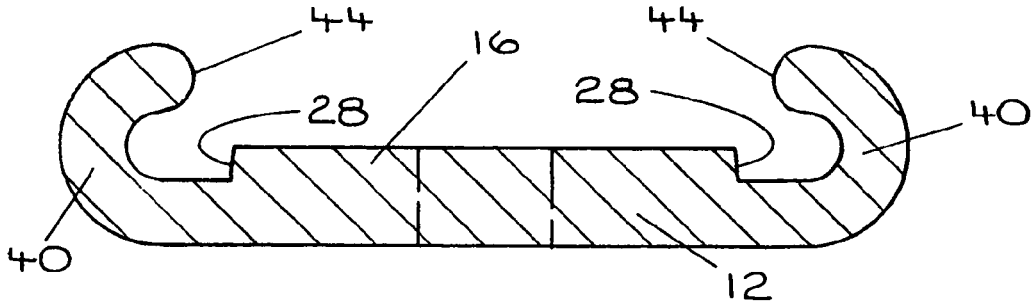
FIG. 9B is the sectional view of the device of FIG. 8B.
Figure 12:
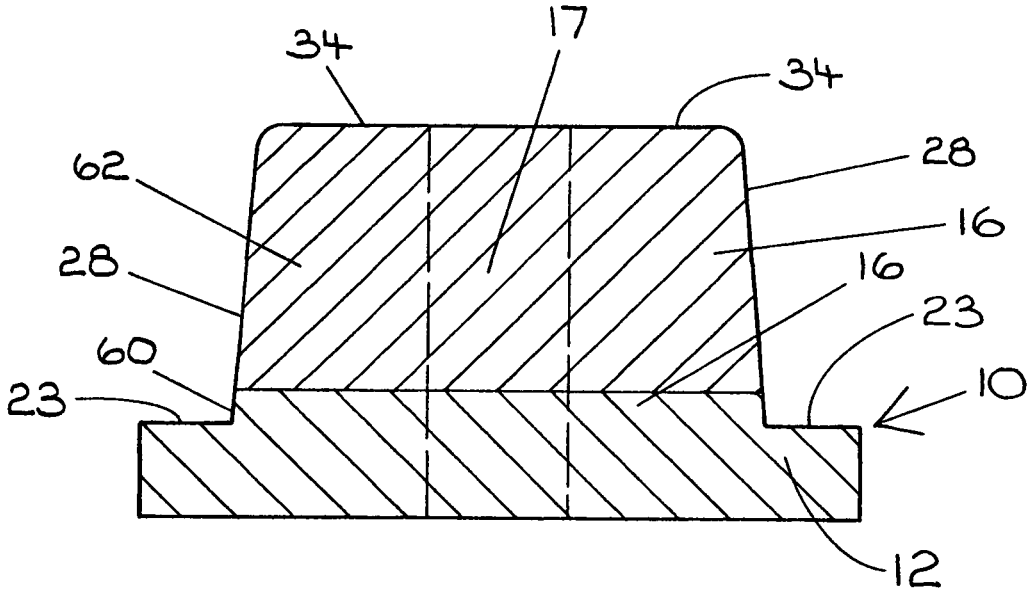
FIG. 12 is the sectional view of the device of FIG. 4B, but with an alignment member 16 configured and dimensioned to congruently engage an inner top wall 50 of the support structure in accordance with the present invention.
Figure 13:
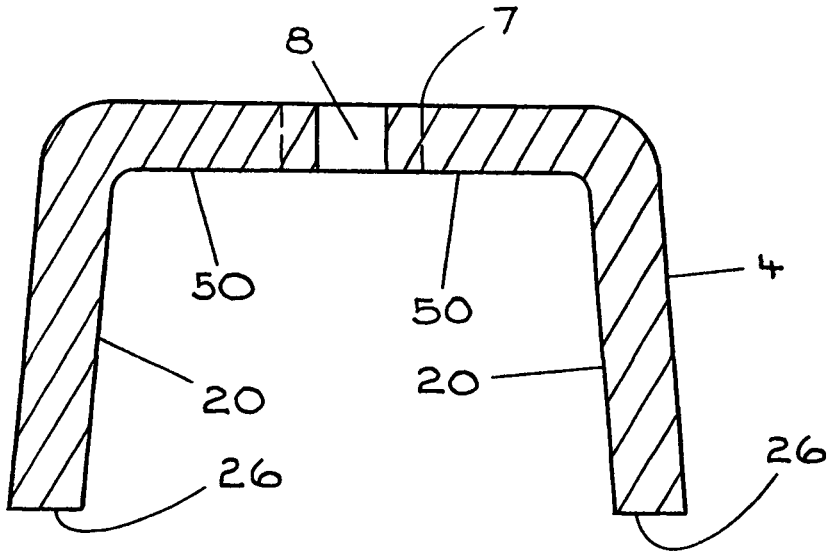
FIG. 13 is the sectional view of the support structure of FIG. 1B.
Figure 14:
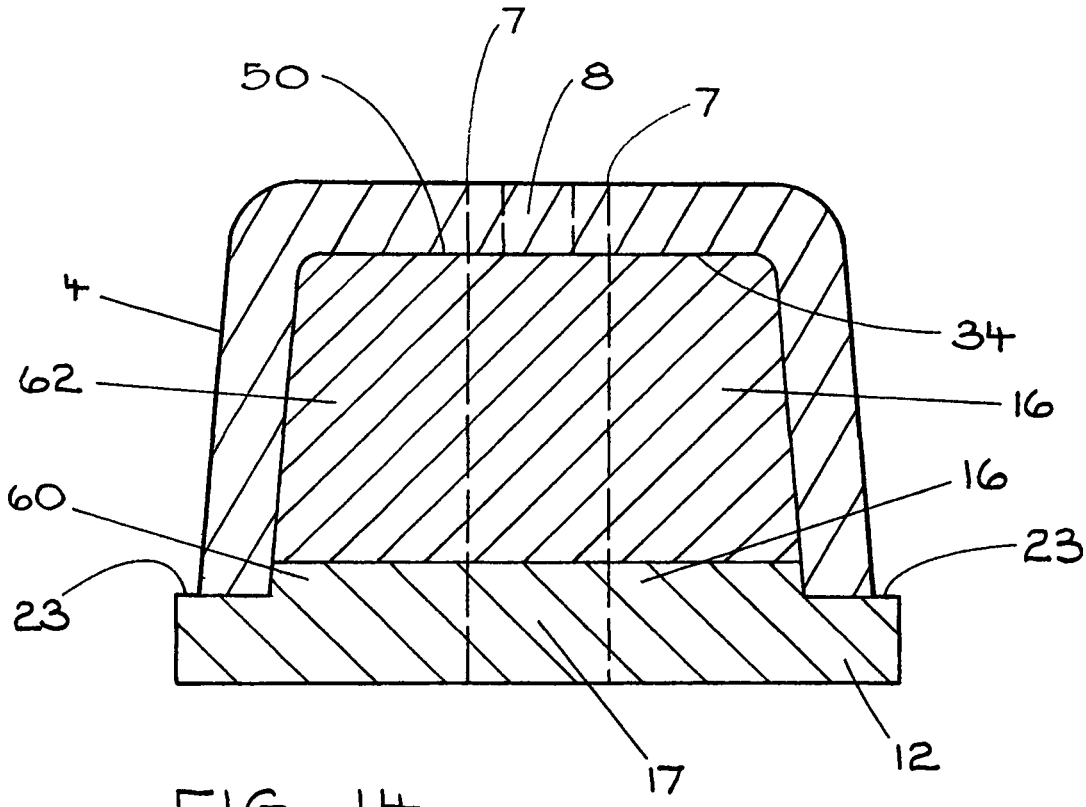
FIG. 14 is a sectional view of the support structure of FIG. 13 disposed upon the device of FIG. 12.

Referring now to FIGS. 12-14, the device 10 of FIG. 4B is depicted but with an alignment member 16 configured and dimensioned to congruently engage the inner angular walls 20 and the inner top wall 50 of the support structure 4 when the bottom walls 26 of the support structure 4 engage the top walls 23 of the distribution member 12 (see FIG. 9). Obviously, any of the alignment members 16 of the above figures can incorporate the alignment member 16 configuration and details of FIGS. 12-14. The congruent engagement between respective walls of the support structure 4 and the alignment member 16 increases the holding force of the device 10 upon the support structure 4, and improves the load distribution of the support structure 4 upon the distribution member 12. The improved load distribution of the support structure 4 allows a heavier load to be imparted upon the support structure without damaging the wall portion 6. The improved load distribution is the result of an increased surface area of the combined top walls 23 and 34 of the distribution member 12 and the alignment member 16, being simultaneously compressed by corresponding bottom walls 26 and the inner top wall 50 of the support structure 4. The combined surface area of the device 10 being compressed by a force imparted upon the support structure 4 correspondingly improves or more evenly distributes the force over the area of the wall portion 6 being engaged by the device 10, thereby reducing the possibility of indentation or damage to the wall portion 6.

The alignment member 16 can be a single integral member or may include joined lower and upper members 60 and 62 that are fabricated from the same or different materials. The deformable and non-deformable materials detailed above to fabricate the load distribution member 12 and the alignment member 16, may be used to fabricate the lower and upper portions 60 and 62. However, a deformable material must be used for the upper portion 62 (if two members are joined to form the alignment member 16) or for the entire single integral member to prevent the obstruction of brackets that are inserted through the bracket slots 8 in the support structure 4. The brackets will engage and deform the alignment member 16 as the brackets are manually urged through the bracket slots 8 and "locked" in position. A non-deformable material may be used to fabricate the upper member 62 if recess (not depicted) are disposed in the upper member 62 such that the recess are cooperatively aligned with the bracket slots 8 to allow the brackets to be manually inserted through the bracket slots 8 without opposition from the upper member 62.

The foregoing description is for purposes of illustration only and is not intended to limit the scope of protection accorded this invention. The scope of protection is to be measured by the following claims, which should be interpreted as broadly as the inventive contribution permits.

The invention claimed is:

1. A backer strip load distribution device for a support structure secured to a wall portion comprising:

a load distribution member disposed between a support structure and a wall portion, said load distribution member disbursing a load imparted upon said device over an area of the wall portion engaged by a back wall of said distribution member, said load distribution member being fabricated from a non-deformable material;

a deformable alignment member for disposing the support structure upon a predetermined portion of said load distribution member, thereby distributing the imparted load upon said load distribution member from the support structure such that the wall portion is not damaged;

means for securing said load distribution member to the support structure, said securing means including relatively small edge portions of said alignment member that ultimately engage inner angular walls of the support structure as the support structure is manually urged closer to said load distribution member until said edge portions forcibly engage the inner angular wall of the support structure, thereby compressing said edge portions to provide a relatively small retaining force that ultimately maintains the support structure upon top walls of said distribution member, irrespective of the orientation of the now assembled support structure and alignment member while a user grasps only the support structure; and means for securing the support structure to the wall portion while said load distribution member is secured to the support structure without said load distribution member obstructing the securing of the support structure to the wall portion, whereby, the backer strip load distribution device is secured to the support structure such that said backer strip load distribution device is disposed between the support structure and the wall portion, thereby preventing engagement of the support structure upon the wall portion and resulting in a distribution of a load from the support structure upon said backer strip load distribution device such that the wall portion is not damaged.

2. The device of claim 1 wherein said alignment member includes side walls that are perpendicular to corresponding top walls of said load distribution member, said top walls ultimately receiving bottom walls of the support structure thereupon.

3. The device of claim 1 wherein said load distribution member includes a color representing force dispersing specifications for said device.

4. The device of claim 1 wherein said alignment member includes angled side walls that cooperate with inner angular walls of the support structure to increase the retaining force of said alignment member for maintaining the support structure upon top walls of said load distribution member.

5. The device of claim 1 wherein said load distribution member is dimensioned to engage bottom walls of the support structure without said alignment member engaging an inner top wall of the support structure.

6. A backer strip load distribution device for a support structure secured to a wall portion comprising:

a load distribution member disposed between a support structure and a wall portion;

an alignment member for disposing the support structure upon a predetermined portion of said load distribution member, said alignment member being fabricated from a material dissimilar to the material of fabrication for said load distribution member;

means for securing said load distribution member to the support structure; and means for securing the support structure to the wall portion while said load distribution member is secured to the support structure without said load distribution member obstructing the securing of the support structure to the wall portion, whereby, a backer strip load distribution device is provided that secures to the support structure such that said backer strip load distribution device is disposed between the support structure and the wall portion, thereby preventing engagement of the support structure upon the wall portion and resulting in a distribution of a load from the support structure upon said backer strip load distribution device such that the wall portion is not damaged.

7. A support structure load distribution device comprising:

a substrate member, said substrate member disbursing a load imparted upon said device by a support structure over an area of a wall portion engaged by a back wall of said substrate member;

an alignment member for disposing the support structure upon a predetermined portion of said substrate member, said substrate member being fabricated from material dissimilar to the material of fabrication for said alignment member;

a securing member for securing the support structure to said substrate member, said securing member including relatively small edge portions of said alignment member that ultimately engage inner angular walls of the support structure as the support structure is manually urged closer to said substrate member until said edge portions forcibly engage the inner angular walls of the support structure, thereby compressing said edge portions to provide a relatively small retaining force that ultimately maintains the support structure upon top walls of said substrate member, irrespective of the orientation of the now assembled support structure and alignment member while a user grasps only the support structure; and means for preventing said substrate member from obstructing the securing of the support structure to the wall portion, whereby, said substrate member is ultimately secured between the support structure and the wall portion, thereby preventing the support structure from damaging the wall portion due load bearing objects being secured to the support structure.

8. The device of claim 7 wherein said substrate member is dimensioned to engage bottom walls of the support structure without said alignment member engaging an inner top wall of the support structure.

* * * * *